US006926275B1

(12) United States Patent
Zocchi

(10) Patent No.: US 6,926,275 B1
(45) Date of Patent: Aug. 9, 2005

(54) FIVE SIDED DICE

(76) Inventor: Louis J. Zocchi, 7604 Newton Dr., R.R. 9, Biloxi, MS (US) 39532-2830

( * ) Notice: Subject to any disclaimer, the term of this patent is extended or adjusted under 35 U.S.C. 154(b) by 0 days.

(21) Appl. No.: 10/458,883

(22) Filed: Jun. 11, 2003

(51) Int. Cl.[7] ..... A63F 3/00
(52) U.S. Cl. ..... 273/146; 273/288
(58) Field of Search ..... 273/146; D21/369–373

(56) References Cited

U.S. PATENT DOCUMENTS 3,399,897 A 9/1968 Mitchell
D267,569 S 1/1983 Polite
4,465,279 A 8/1984 Larson
D283,632 S 4/1986 Moore
D299,497 S 1/1989 Reidenbach et al.
4,989,875 A 2/1991 Capy et al.
5,203,562 A * 4/1993 Smith ..... 273/146
5,261,666 A * 11/1993 Chen et al. ..... 273/146
6,435,504 B1 * 8/2002 Nightingale ..... 273/272

OTHER PUBLICATIONS

Ex.Parte Breslow 182 USPQ 431.*

* cited by examiner

*Primary Examiner*—Vishu K. Mendiratta
(74) *Attorney, Agent, or Firm*—George L. Williamson

(57) ABSTRACT

The present invention discloses a fair five-sided dice which has a pair of oppositely opposed triangularly shaped faces and three rectangular shaped faces. Indicia are disposed on each of the faces for indicating the numerals one through five. One of each of the numerals one and five are disposed on one of each of the triangular shaped faces while the numerals two and three are disposed on one rectangular shaped face, the numerals three and four are disposed on a second rectangular shaped face and numerals two and four are disposed on a third rectangular shaped face in such a way that if the numerals two, three or four are cast they appear upright to a user.

14 Claims, 1 Drawing Sheet

FIVE SIDED DICE

BACKGROUND OF THE INVENTION

1. Field of the Invention

The present invention relates generally to dice and, more particularly, is concerned with a five-sided dice.

2. Description of the Prior Art

Multiple sided dice have been described in the prior art; however, none of the prior art devices disclose the unique features of the present invention. A search of the prior art has been conducted by the applicant, and no prior art five-sided dice have been found.

In U.S. Pat. No. 4,465,279, dated Aug. 14, 1984, Larson disclosed a playing device, in particular, a die having a body shape as a regular dodecahedron having twelve faces and a plurality of countable indicia one to six. Each total from one to six appears on precisely two opposite faces. Moreover, the two faces containing a given total lie on parallel opposing faces so that each opposite face is provided with the same number of recesses and therefore the die will be evenly balanced at all parts from its center. Each indicia is conical in shape and is recessed in the body adjacent to the dodecahedron faces. The faces of the die are pentagonal in shape and the placement of the indicia are such that the indicia on each planar face is identical to the number of indicia on the opposite planar face parallel to the first mentioned planar face. Thereby providing a perfect balanced die with its center of mass coinciding with its geometrical center whereby greater random playing results are achieved and less chance for trickery.

In U.S. Pat. No. 4,989,875, dated Feb. 5, 1991, Capy, et al., disclosed a die containing eight planar hexagonal surfaces and six convex portions capable of producing random results when thrown. The convex faces are dimensioned so as to constitute areas of unstable equilibrium to favor positioning of the die on one of the hexagonal surfaces when so thrown. The die can be marked with card values and suits associated with a deck of playing cards whereby a set containing the marked dice can be utilized to play poker card games. Moreover, the card values and suits can be positioned on the dice so that marking of the dice can be performed in a two pass printing process.

In U.S. Pat. No. 3,399,897, dated Sep. 3, 1968, Mitchell disclosed a concept which has to do with an octahedral die which is as nearly perfectly balanced in a numerical and physical sense as is reasonably possible. The totals around all six corners equal 18 and the sides 1-2,3-4, 5-6 and 7-8 are opposed. When this die is cast from the hand and comes to rest on a flat surface, the facet or side facing skyward is opposed to the unreadable downward side. Significantly, the same amount of material is not taken from each side but from around a given reference point. This die is unique in that it is eight-sided and has sequentially oriented dimpled pips which coordinate in totaling 18 around any given corner.

In U.S. Pat. No. Des. 299,497, dated Jan. 24, 1989, Reidenbach, et al., disclosed the ornamental design for a game die, as shown and described.

In U.S. Pat. No. Des. 283,632, dated Apr. 29, 1986, Moore disclosed the ornamental design for a game die, as shown and described.

In U.S. Pat. No. Des. 267,569, dated Jan. 11, 1983, Polite disclosed the ornamental design for a ten-sided die, substantially as shown and described.

While these multiple sided dice may be suitable for the purposes for which they were designed, they would not be as suitable for the purposes of the present invention, as hereinafter described.

SUMMARY OF THE PRESENT INVENTION

The present invention discloses a five-sided dice which has a pair of oppositely opposed equilateral triangularly shaped faces and three rectangular shaped faces. Indicia are disposed on each of the faces for indicating the numerals one through five. One of each of the numerals 1 and 5 are disposed on one of each of the triangular shaped faces while the numerals 2 and 3 are disposed on one rectangular shaped face; numerals 3 and 4 are disposed on a second rectangular shaped face and numerals 2 and 4 are disposed on a third rectangular shaped face in such a way that only one numeral appears in an upright fashion when the dice is cast and lands on the corresponding edge.

An object of the present invention is to provide a fair, five-sided dice for use in various dice games and dice related events. A further object of the present invention is to provide a dice which can be simply and easily manufactured so as to reduce the cost of the present invention.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
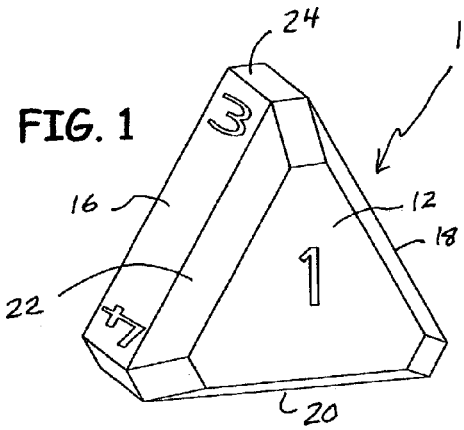
FIG. 1 is a perspective view of one face of the dice.

With regard to reference numerals used, the following numbering is used throughout the drawings.

10 present invention
12 triangular face
14 triangular face
16 rectangular face
18 rectangular face
20 rectangular face

22 beveled edge
24 truncated vertex
A dimension
B dimension
C dimension

DETAILED DESCRIPTION OF THE PREFERRED EMBODIMENT

The following discussion describes the present invention in detail. This discussion should not be construed, however, as limiting the invention to those particular embodiments since practitioners skilled in the art will recognize numerous other embodiments as well.

Figure 2:
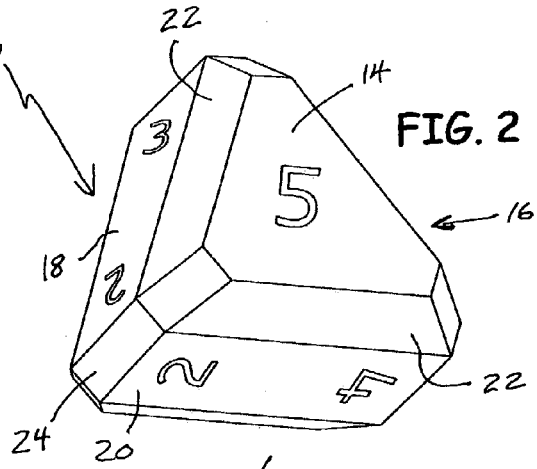
FIG. 2 is a perspective view of another face of the present invention.
Figure 3:
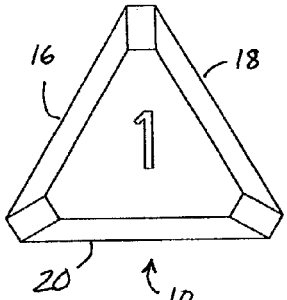
FIG. 3 is a plan view of one face of the present invention.
Figure 4:
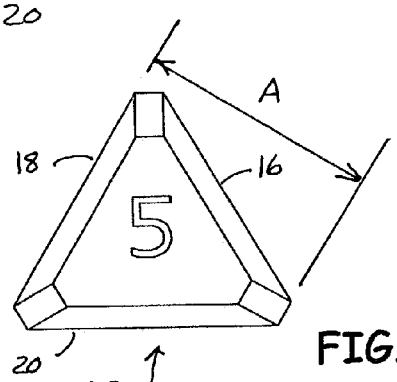
FIG. 4 is a plan view of another face of the present invention.
Figure 5:
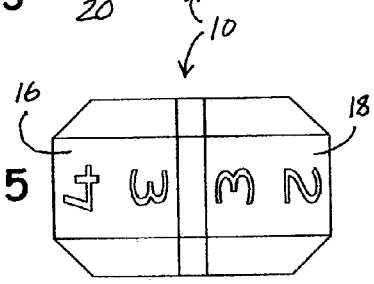
FIG. 5 is an elevation view of the present invention.
Figure 6:
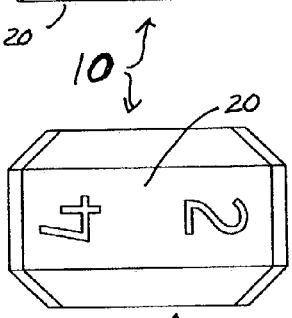
FIG. 6 is an elevation view of the present invention.
Figure 7:
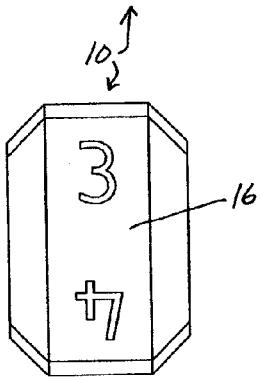
FIG. 7 is an elevation view of the present invention.

Turning to FIGS. 1 and 2, shown therein are perspective views of the present invention 10 showing in FIG. 1 an equilateral triangular shaped face 12 showing the numeral one or "1" and in FIG. 2 an opposite triangular face 14 having the numeral five or "5" imprinted thereon. Also shown are rectangular faces 16, 18 and 20 on the edges between the triangular faces wherein face 16, 18, 20 has two numerals each imprinted thereon so that if a rectangular face 20 lands face down on the surface, there would be an upright "3" shown on the face 16 and a corresponding upright "3" shown on the face 18. The same correspondence applies to the other rectangular faces. Beveled edge 22 is also shown between the triangular faces and the rectangular faces. Also the blunted or truncated vertexes 24 of the triangles are shown at the point of joinder of the edges of the triangles.

Figure 8:
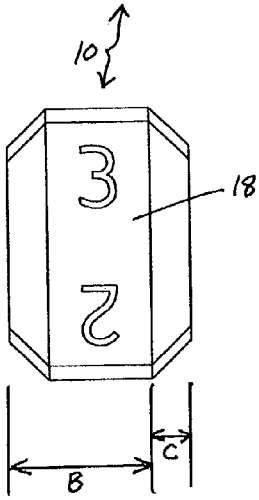
FIG. 8 is an elevation view of the present invention.

Turning to FIGS. 3 through 8, therein are shown additional views of the present invention 10. It can be seen in FIG. 5 that the numeral "3" shown on face 16 is adjacent to the numeral "3" shown on face 18. Also shown are various dimensions of the dice of the present invention 10 showing in FIG. 4 a dimension at A of 17.96 millimeters; FIG. 8 shows a dimension B being 13.60 millimeters and a dimension C being 3.18 millimeters. Beveled edges 22 are shown between each of the triangular faces 12 and 14 and each of the rectangular faces, 16, 18 and 20. The beveled edges make the shape of the present invention 10 interesting and its multiple angular edges capture and radiate illumination which enhances the lustrous and sparkling gem-like appearance of the present invention 10. Also note that the ratio of 3.18 millimeters to 13.60 millimeters is about 0.2338 millimeters.

The present invention has been tested for fairness wherein different sizes of dice were included in the test ranging from 13–18 millimeters in thickness. Each of these shapes has been test rolled or cast more than 10,000 times. During initial testing, it was felt that the 14 millimeter thickness was the closest size to providing equally random outcomes for each of the five faces so that each face would occur one-fifth of the time. Specifically, 10,163 rolls were made of the 14 millimeter thickness test dice which yielded 6,152 rolls in which a rectangular silhouette was seen and 4,011 rolls which yielded a triangular silhouette. This means that the two triangular faces came up 4,011/10,163=0.3947 of the time. If the dice was perfectly fair, those faces should come up exactly 04000 of the time. Given the number of rolls, the uncertainty (one standard deviation) was estimated to he 0.0070 which indicates that the experiment detected no significant deviation from fairness. This testing was done on a table made of 12 millimeter thick Plexiglas, otherwise known as acrylic or lexan.

Further testing of the dice was done on a table made of six millimeter thick Plexiglas. These tests indicated that the dice should be 13.9 millimeters thick in order to yield a fair dice.

Still further testing was done again on a table of 12 millimeter thick Plexiglas and it was determined that the dice should be 13.6 millimeters thick to be fair. It is believed that the type of material that the dice is rolled on could have a bearing on its fairness and therefore the fairness of the dice may vary with these types of surfaces.

Based on all of the testing, it is believed that a thickness of about 13.6 millimeters is the preferred thickness of the present invention. This is the thickness shown in FIG. 8 wherein the thickness is shown to be 13.6 millimeters. However, it is believed that the dice may be ultimately manufactured in a range of size from 13 to 15 millimeters depending on the type of material they are to be used on.

I claim:

1. A five-sided dice, comprising:

a) a pair of oppositely opposed equilateral triangular shaped faces having edges thereon;

b) three rectangular shaped flat faces disposed on said edges having adjoining sides of said rectangular shaped faces;

c) numerical indicia disposed on said triangular shaped faces and said rectangular shaped faces wherein matching indicia are located on said rectangular shaped faces adjacent said adjoining sides.

2. The five-sided dice of claim 1, wherein the numeral one is disposed on said first triangular face and the numeral five is disposed on said second triangular face.

3. The five-sided dice of claim 2, wherein the numerals two and three are disposed on said first rectangular shaped face, wherein the numerals three and four are disposed on said second rectangular shaped face, and wherein the numerals two and four are disposed on said third rectangular shaped face, thereby allowing each of said numerals two, three and four appearing on opposite sides of edges adjoining adjacent rectangular shaped faces.

4. The five-sided dice of claim 3, wherein the numerals three are disposed adjacent each other on said first and second rectangular shaped faces to permit the numeral three to be displayed upright when the dice land on said third rectangular shaped face.

5. The five-sided dice of claim 4, wherein the numerals two are disposed adjacent each other on said first and third rectangular faces to permit the numeral two to be displayed upright when the dice lands on said second rectangular shaped face.

6. The five-sided dice of claim 5, wherein the numerals four are disposed adjacent each other on said second and third rectangular faces to permit the numeral four to be displayed upright when the dice lands on said first rectangular shaped face.

7. The five-sided dice of claim 6, further comprising a beveled edge being disposed between each of said triangular shaped faces and each of said rectangular shaped faces to permit a plurality of light beams to penetrate the dice.

8. The five sided dice of claim 7, wherein the perpendicular distance between said first and second triangular shaped faces is 13 millimeters to 15 millimeters.

9. The five-sided dice of claim 8, wherein the perpendicular distance between said first and second triangular shaped faces is 13.4 millimeters to 14 millimeters.

10. The five-sided dice of claim 9, wherein the perpendicular distance between said first and second triangular shaped faces is 13.6 millimeters to 13.9 millimeters.

11. The five-sided dice of claim 10, wherein the perpendicular distance between said first and second triangular shaped faces is 13.6 millimeters.

12. The five-sided dice of claim 11, wherein the perpendicular distance from either of said first or second triangular shaped faces and the closest edge of either of said first, second or third rectangular shaped faces is 3.18 millimeters.

13. The five-sided dice of claim 12, wherein the ratio of the distance from either of said first or second triangular shaped faces and the closest edge of either of said first, second or third rectangular shaped faces to the distance between said first and second triangular shaped faces is equal to 3.18 millimeters divided by 13.60 millimeters having a value of about 0.2338.

14. The five-sided dice of claim 13, wherein the distance from said first rectangular face to the junction point of said second and third rectangular face is 17.96 millimeters.

* * * * *